US005672932A

United States Patent [19]

Goldman

[11] Patent Number: 5,672,932

[45] Date of Patent: Sep. 30, 1997

[54] COMPACT LAMP ASSEMBLY WITH TUBULAR PORTIONS ARRANGED IN V-SHAPED CONFIGURATION

[76] Inventor: Dennis Goldman, 3 Wells Avenue, Parkwood, Johannesburg, South Africa

[21] Appl. No.: 512,746

[22] Filed: Aug. 8, 1995

Related U.S. Application Data

[63] Continuation-in-part of Ser. No. 56,201, May 4, 1993, abandoned.

[30] Foreign Application Priority Data

May 4, 1992 [ZA] South Africa ..... 92/3212

[51] Int. Cl.[6] ..... H01J 7/44

[52] U.S. Cl. ..... 313/318.01; 313/634; 313/493

[58] Field of Search ..... 362/263, 265, 362/301, 298, 297, 343, 221; 439/235, 236, 231, 642, 646; 313/634, 318.01, 493, 113, 114; 315/70, 71, 56, 58, 35, 64; D26/75, 76, 78

[56] References Cited

U.S. PATENT DOCUMENTS

| | | | |
|---|---|---|---|
| 3,564,234 | 2/1971 | Phlieger, Jr. . | |
| 4,187,446 | 2/1980 | Gross et al. . | |
| 4,300,073 | 11/1981 | Skwirut et al. | 313/220 |
| 4,383,200 | 5/1983 | Van Zon et al. . | |
| 4,389,595 | 6/1983 | Kamei et al. . | |
| 4,417,176 | 11/1983 | Kamei et al. . | |
| 4,456,854 | 6/1984 | Osada et al. . | |
| 4,871,944 | 10/1989 | Skwirut et al. . | |
| 5,128,590 | 7/1992 | Holzer . | |

FOREIGN PATENT DOCUMENTS

| | | |
|---|---|---|
| 0210877A1 | 2/1987 | European Pat. Off. . |
| 0447957A2 | 9/1991 | European Pat. Off. . |

*Primary Examiner*—Sandra L. O'Shea
*Assistant Examiner*—Vip Patel
*Attorney, Agent, or Firm*—Jacobson, Price, Holman & Stern, PLLC

[57] ABSTRACT

A compact low pressure discharge lamp assembly is disclosed for use in a lighting fixture. The assembly has a base terminating in a fitting and at least one discharge tube including at least two elongated tubular portions The two elongated tubular portions having fixed ends terminating at the base and opposed free ends. A control circuit housing is mountable to the base opposite the fitting, and a first of elongated tubular portion extends away from the base and is splayed away from another elongated tubular portion to define a V-shaped configuration. The control circuit housing has a wedge-shaped profile for allowing it to nest within the V-shaped configuration, and the discharge lamp assembly has a maximum width dimension determined by the distance between the outermost surfaces of the free ends of the discharge tubes.

7 Claims, 10 Drawing Sheets

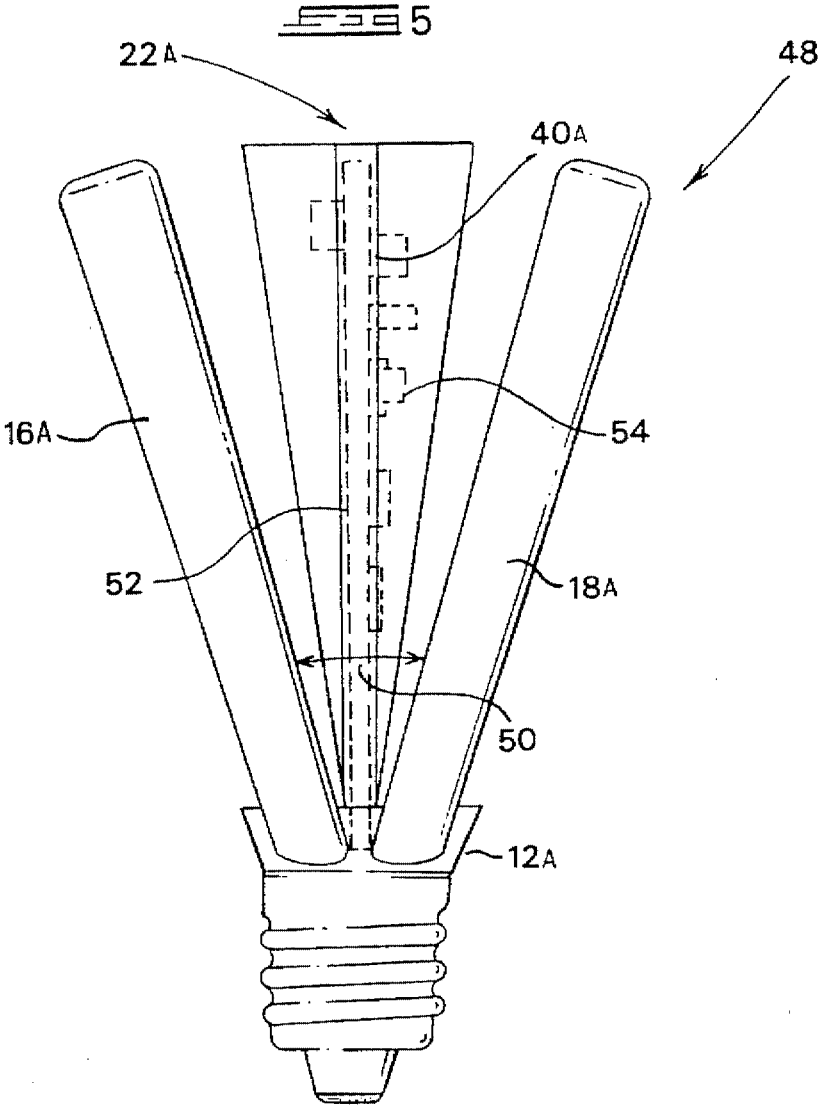
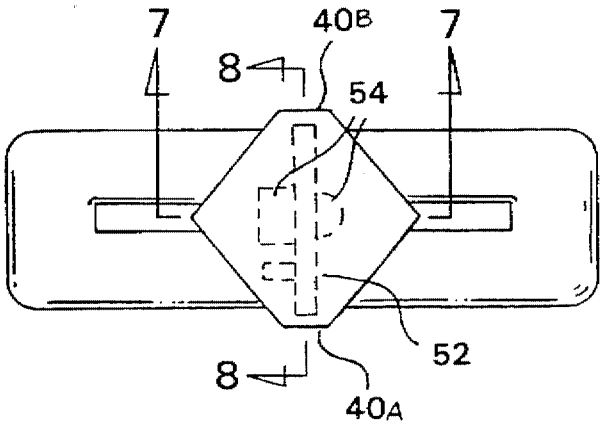
6

| cd/klm | Ave. Intensity degree | Ave. Intensity cd/klm |
|---|---|---|
| 0 | 180 | 0 |
| 50 | 175 | 0 |
| 100 | 165 | 0 |
| 150 | 155 | 0 |
| 200 | 145 | 1 |
| 250 | 135 | 1 |
| 300 | 125 | 0 |
| 350 | 115 | 0 |
| 400 | 105 | 0 |
| 450 | 95 | 1 |
| 500 | 90 | 1 |
| | 85 | 1 |
| | 75 | 1 |
| | 65 | 1 |
| | 55 | 34 |
| | 45 | 158 |
| | 35 | 264 |
| | 25 | 327 |
| | 15 | 437 |
| | 5 | 519 |
| | 0 | 514 |

| Ave. Intensity | |
|---|---|
| degree | cd/klm |
| 180 | 0 |
| 175 | 1 |
| 165 | 1 |
| 155 | 1 |
| 145 | 0 |
| 135 | 0 |
| 125 | 1 |
| 115 | 0 |
| 105 | 0 |
| 95 | 0 |
| 90 | 1 |
| 85 | 0 |
| 75 | 1 |
| 65 | 2 |
| 55 | 12 |
| 45 | 97 |
| 35 | 241 |
| 25 | 370 |
| 15 | 537 |
| 5 | 556 |
| 0 | 536 |

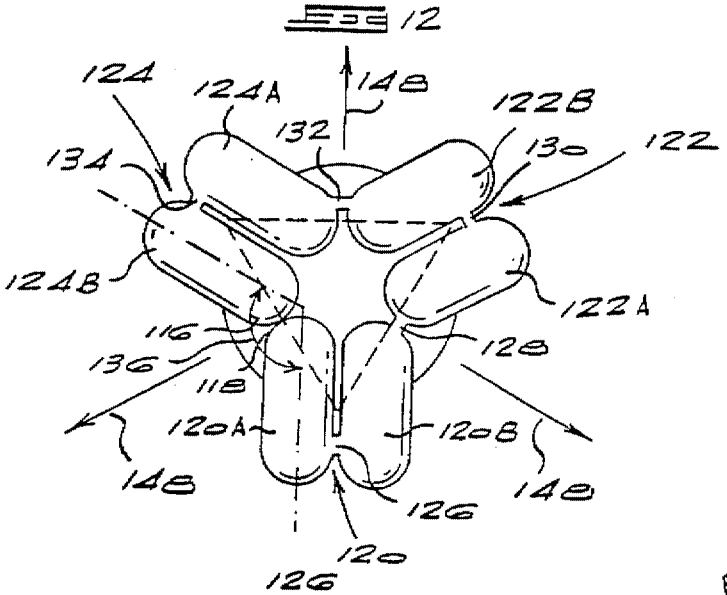
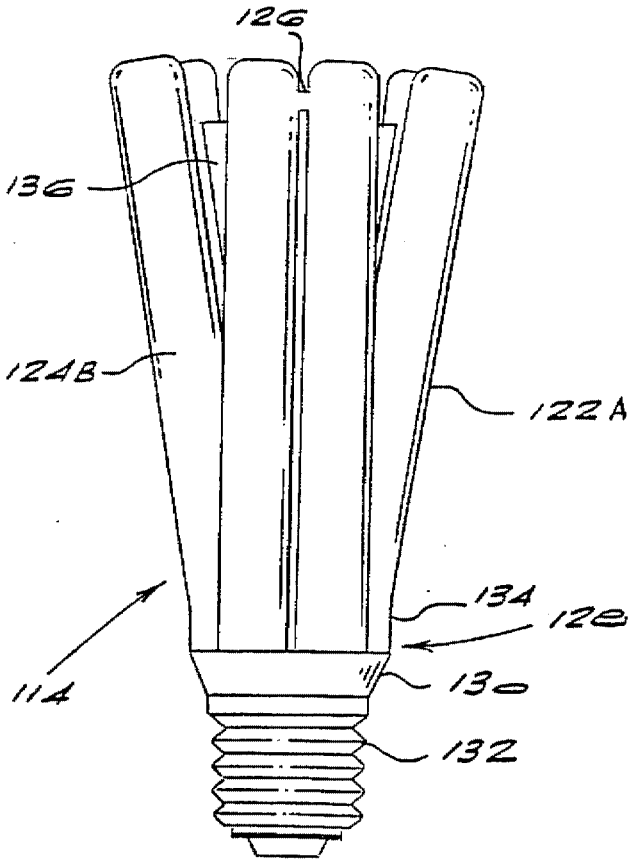
13
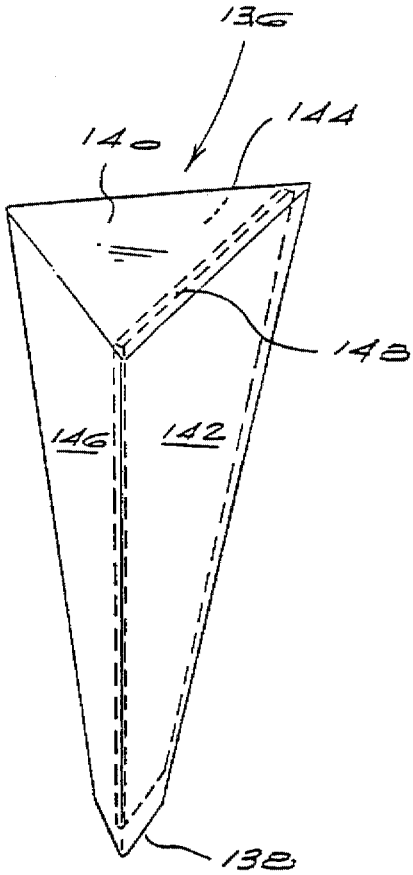
14

Fig 15
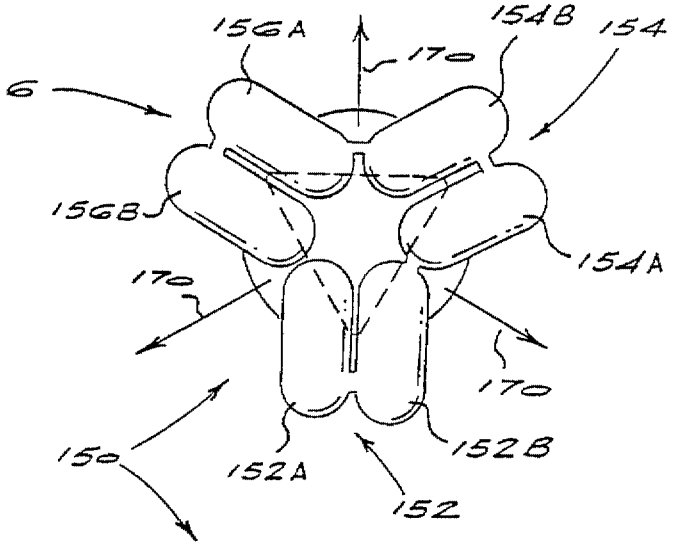
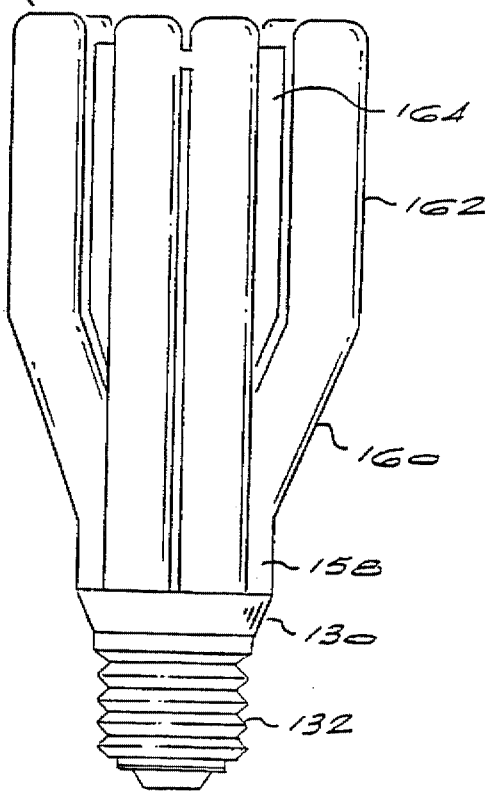
Fig 16
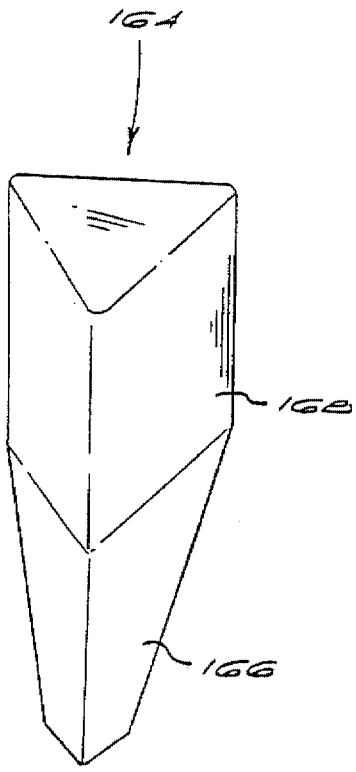
Fig 17

FIG 18
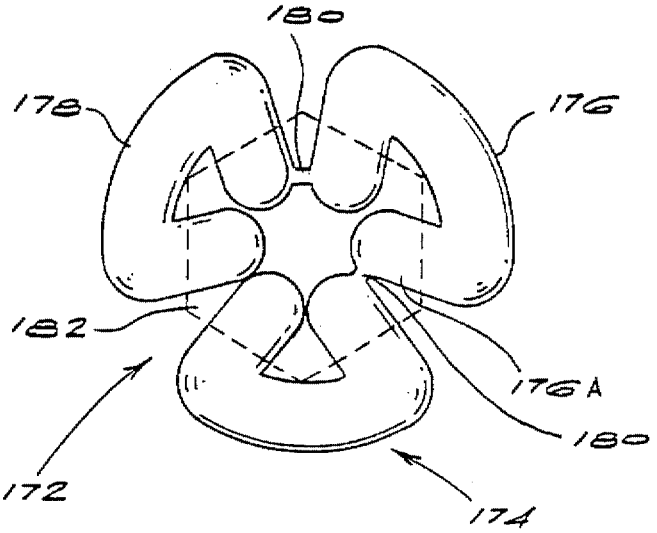
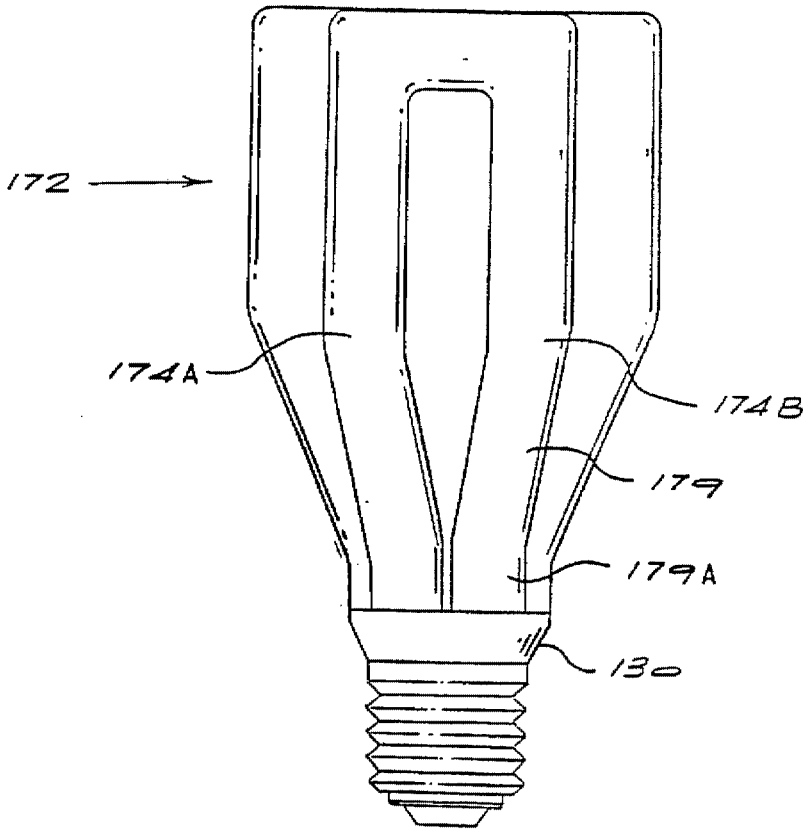
FIG 19

COMPACT LAMP ASSEMBLY WITH TUBULAR PORTIONS ARRANGED IN V-SHAPED CONFIGURATION

CROSS-REFERENCE TO RELATED APPLICATION

This application is a continuation-in-part of application Ser. No. 08/056,201 filed on 4 May 1993, and abandoned on 9 Aug. 1995.

BACKGROUND OF THE INVENTION

This invention relates to a low pressure discharge lamp assembly, and in particular to a low pressure mercury vapour discharge lamp assembly.

Low pressure mercury vapour discharge lamps, such as those described in European patent application EP 00274780, have, owing to their significantly reduced power consumption and increased lifespan, become increasingly popular as replacements for convention incandescent filament lamps. A lamp of this type comprises an H-shaped discharge tube terminating at one end in a connector which can be plugged into a base.

One problem associated with compact low pressure discharge lamps is that they require electromechanical electronic ballasts and the starter and other control circuitry in order to enable them to operate. These additional components, together with the length of the discharge tubes, do not lend themselves to a compact construction.

Most individual light fixtures and housings are specifically adapted to receive conventional incandescent filament light bulbs. A low pressure discharge lamp assembly which does not share or at least approximate the critical dimensions of a conventional incandescent light bulb cannot, as a general rule, be interchanged freely with its incandescent counterpart. The power saving advantages of low pressure discharge lamps and their relative longevity clearly cannot be readily enjoyed if the particular shape and configuration does not allow them to be fitted to existing incandescent light fixtures and housings. By way of example, the discharge lamp assembly of the type described in EP 00274870 is generally too long to fit into a conventional incandescent light housing.

European patent publication 0447957 to Holzer discloses a compact fluorescent light fitting having a base from which an elongate cylindrical control circuit housing extends. At least one discharge tube surrounds the control circuit housing, and similarly has a cylindrical profile. A disadvantage of this construction is that the maximum width dimension of the assembly is contributed by the base adjacent the screw connector of the fitting. The width dimension of the discharge tube or tubes is only slightly less than that of the base, and extends uniformly for the length of the discharge tube(s). This broad-based cylindrical profile is very different to that of a convention incandescent light bulb, which has a narrow base followed by a narrowed neck portion with terminates in a bulbous portion. As a result, the number of conventional incandescent light fittings to which the various arrangements disclosed in Holzer can be fitted is somewhat limited.

U.S. Pat. No. 4,871,944 to Skwirut discloses a compact fluorescent lamp having a similar cylindrical arrangement to that disclosed in Holzer. A multi-U-bent tubular envelope having a cylindrical profile extends from the base, and surrounds a square cylindrical control circuit housing. The maximum width dimension of the arrangement is contributed by the base, with the aforementioned disadvantages. Further, the overall height dimension of the arrangement is increased due to the fact that a significant portion of the electrical circuitry is housed within the base.

SUMMARY OF THE INVENTION

According to the invention there is provided a compact low pressure discharge lamp assembly for use in a lighting fixture comprising:

a base terminating in a fitting;

at least one discharge tube including at least two elongated tubular portions, said at least two elongated tubular portions having fixed ends terminating at the base and opposed free ends; and a control circuit housing mountable to the base opposite the fitting, a first of said at least two elongated tubular portions extending away from the base and being splayed away from another of said at least two elongated tubular portions to define a V-shaped configuration, the control circuit housing having a wedge-shaped profile for allowing it to nest within the V-shaped configuration, said discharge lamp assembly having a maximum width dimension by the distance between outermost surfaces of the free ends of the discharge tubes.

In one form of the invention, the compact low pressure discharge lamp assembly comprises only one discharge tube having six of said elongated tubular portions arranged such that:

a first of said tubular portions is disposed adjacent and substantially parallel to a second of said tubular portions to define a first pair of tubular portions;

a third of said tubular portions is disposed adjacent and substantially parallel to a fourth of said tubular portions to define a second pair of tubular portions;

a fifth of said tubular portions is disposed adjacent and substantially parallel to a sixth of said tubular portions to define a third pair of tubular portions;

said first, second and third pairs of tubular portions being mutually splayed away from one another such that said V-shaped configuration exists:

between said first pair of tubular portions and said second pair of tubular portions;

between said second pair of tubular portions and said third pair of tubular portions; and between said third pair of tubular portions and said first pair of tubular portions.

Alternatively, said at least one discharge tube comprises a pair of discharge tubes having fixed ends mounted to the base and opposed free ends, and a control circuit housing mountable to the base opposite the fitting and located between the discharge tubes, the discharge tubes extending away from the base and being splayed away from one another to define said V-shaped configuration.

Conveniently, said base has lateral dimensions substantially smaller than the maximum width dimension of the discharge lamp assembly so that no contribution to the maximum width dimension of the discharge lamp assembly is made by the base, and wherein said V-shaped configuration is taller than the control circuit housing so that no contribution to a height dimension of the assembly is made by the control circuit housing.

Preferably, the control circuit housing houses electronic components for controlling the operation of the discharge tubes, including a ballast circuitry and a starter circuitry, said electronic components being located inside said V-shaped configuration and being shorter than said V-shaped configuration so that the electronic components are not contributing to the height and maximum width dimensions of the assembly.

Typically, the control circuit housing has at least one pair of reflective faces which are arranged to reflect light emitted from the at least one discharge tube, each of said reflective faces being angled relative to the discharge tube so as to provide a substantially even distribution of reflected light from the discharge tubes.

Advantageously, the control circuit housing is detachably mountable to the base via an electromechanical connection, the electromechanical connection including a first set of connectors for connecting the fitting electrically to the control circuit for powering thereof and a second set of connectors for connecting outputs from the control circuit to input leads connected to the discharge tube.

Typically, the control circuit housing includes an electromagnetic and radio frequency interference shield for protecting the control circuit.

BRIEF DESCRIPTION OF THE DRAWINGS

FIG. 5 shows a partly cut away side view of second embodiment of a mercury vapour low pressure discharge lamp assembly of the invention;

FIG. 6 shows a top plan view of the embodiment of FIG. 5;

FIG. 12 shows a top plan view of a fourth embodiment of a low pressure discharge lamp assembly of the invention;

FIG. 13 shows a side view of the low pressure discharge lamp assembly of FIG. 12;

FIG. 14 shows a perspective view of control circuit housing forming part of the discharge lamp assembly of FIGS. 12 and 13:

FIG. 15 shows a top plan view of a fifth embodiment of a low pressure discharge lamp assembly of the invention;

FIG. 16 shows a side view of the lamp assembly of FIG. 15;

FIG. 17 shows a perspective view of a control circuit housing forming part of the lamp assembly of FIGS. 15 and 16;

FIG. 18 shows a top plan view of a sixth embodiment of a low pressure discharge lamp assembly of the invention;

FIG. 19 shows a side view of the low pressure discharge lamp assembly of FIG. 18;

DESCRIPTION OF THE PREFERRED EMBODIMENTS

Figure 1:
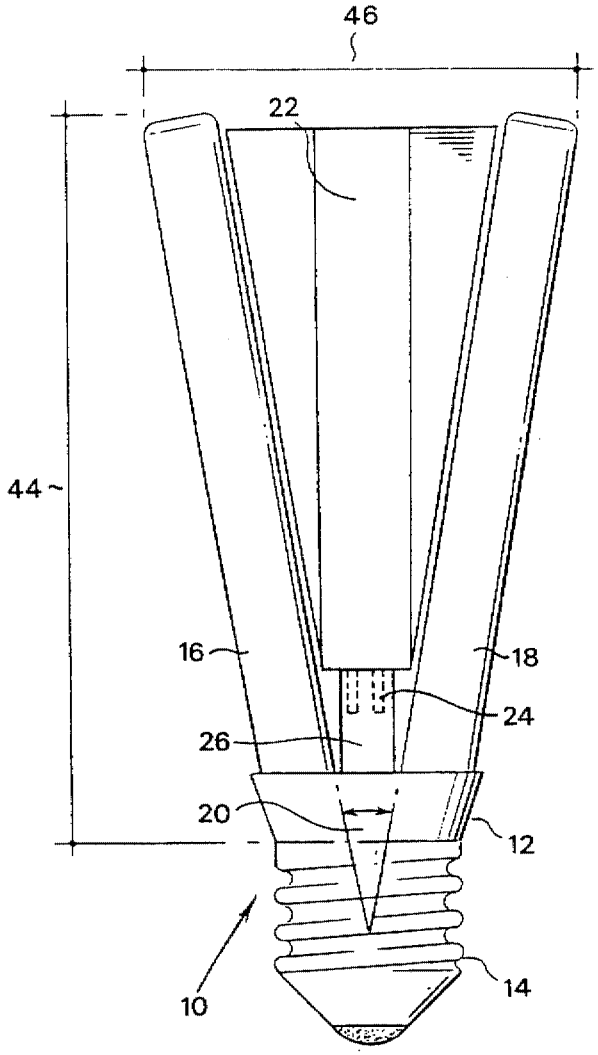
FIG. 1 shows a side view of a first embodiment of a mercury vapour low pressure discharge lamp assembly of the invention.
Figure 2:
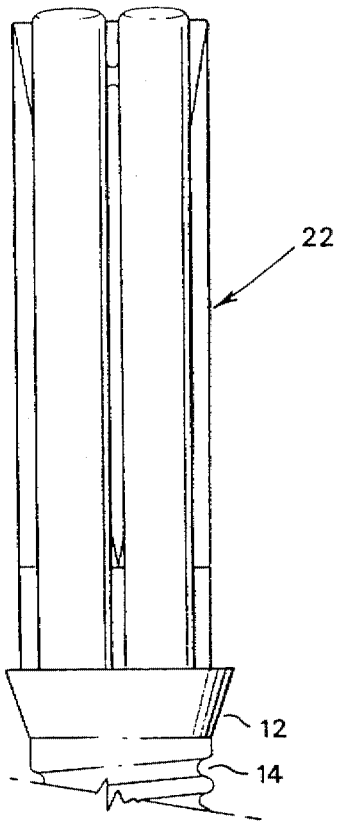
FIG. 2 shows a front view of the low pressure discharge lamp assembly of FIG. 1.
Figure 3:
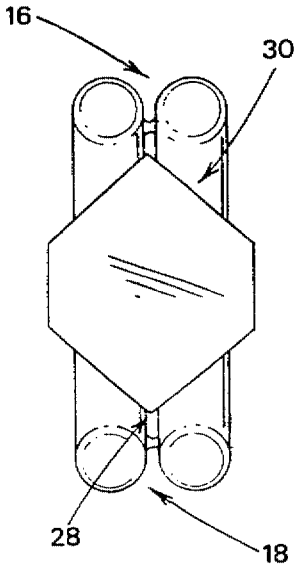
FIG. 3 shows a top plan view of the low pressure discharge lamp assembly of FIGS. 1 and 2.

Referring first to FIGS. 1 to 3, a first embodiment of a low pressure mercury vapour discharge lamp assembly 10 comprises a base 12 terminating in a screw connector fitting 14. A pair of 7 Watt H-shaped biaxial mercury discharge tubes 16 and 18 of the type manufactured by General Electric extend upwardly from the base in a V-configuration, and are angled from one another at an included angle of approximately 24°, as is shown at 20. The discharge tubes 16 and 18 flank a central housing 22 which is wedge-shaped in profile. The central housing 22 houses electronic starter circuitry as a well as a choke or ballast. The housing 22 has connection pins 24 which allow it to be plugged into a socket arrangement 26 which extends axially from the centre of the base 12.

The housing preferably has a reflective metallic coating, such as an aluminium coating, applied to its outer surface by vacuum deposition for enhancing its reflectivity. The metallic coating doubles as an electromagnetic and radio frequency interference shield for effectively shielding the control circuitry. Cathode sputtering, using alternating layers of steel with an intermediate copper layer sandwiched therebetween, may also be employed. The reflective outer surface may alternatively be constituted by a white plastics material having a gloss finish. A further option is to spray a conductive nickel coating onto the outer surface of the housing.

Figure 4:
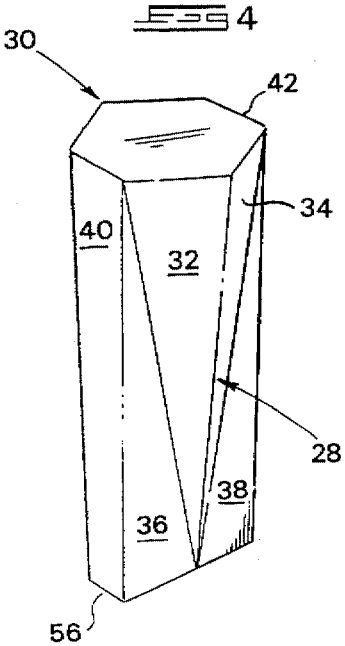
FIG. 4 shows a perspective view of the control circuit housing of the low pressure discharge lamp assembly of FIGS. 1 to 3.

As can be seen in FIG. 4, the housing has a pair of opposed reflective faces 28 and 30, which are arranged to reflect light emitted from the discharge tubes 16 and 18. Each face comprises a raised pair of triangular facets 32 and 34 flanked by a flat pair of triangular facets 36 and 38. Rectangular side faces 40 and 42 extend between the opposed faces 28 and 30. The facets 32 and 34 are angled at approximately 110° from one another in order to provide an even distribution of reflected light from the respective discharge tubes 16 and 18.

The overall length 44 of the discharge lamp assembly from the top of the screw connector 14 to the end of the discharge tubes 16 and 18 is approximately 102 mm. The maximum width 46 of the discharge lamp assembly is approximately 55 mm. These dimensions allow the discharge lamp assembly to be housed within conventional light fittings which are designed to accommodate conventional 60 Watt or 100 Watt incandescent filament-type light bulbs. The compactness of the lamp assembly is achieved largely by the position of the control circuit housing 22, which houses both the starter circuit and the ballast alongside, rather than beneath the fluorescent tubes 16 and 18. As a result, the overall length of the lamp assembly is considerably reduced. In addition, the relatively spacious wedge-shaped configuration of the control circuit housing provides for automated assembly of the electronic components housed therein.

Once the discharge tubes have reached the end of their lifespan, the housing 22 is unplugged from the base and the discharge tubes 16 and 18 and the base 12 to which they are mounted are disposed of. The housing 22 is then plugged into a replacement base 12, from which fresh discharge tubes 16 and 18 extend.

Referring now to FIG. 6, a second embodiment of a fluorescent lamp assembly 48 is shown which is similar to the embodiment of FIGS. 1 to 4, with a pair of U-shaped tubes 16A and 18A being angled further apart from one another at an included angle of 30°, as is shown at 50. The central housing 22A is of substantially the same shape as the central housing 22, save that it has rectangular side faces 40A and 42A which are substantially narrower than the rectangular side faces 40 and 42. A printed circuit board, which is indicated in broken outline at 52, is populated with various circuit components 54, including starter circuitry and at least one ballast or choke.

Figure 7:
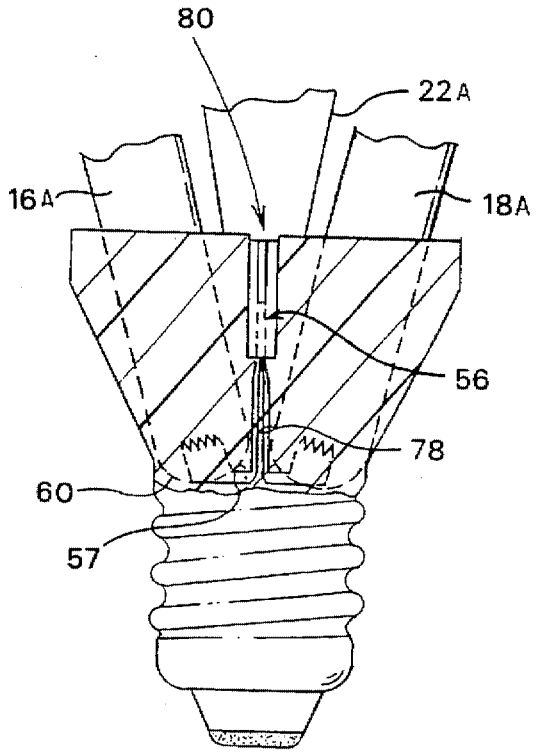
FIG. 7 shows a cross-section of a lower portion of the discharge lamp assembly on the line 7—7 of FIG. 6.
Figure 8:
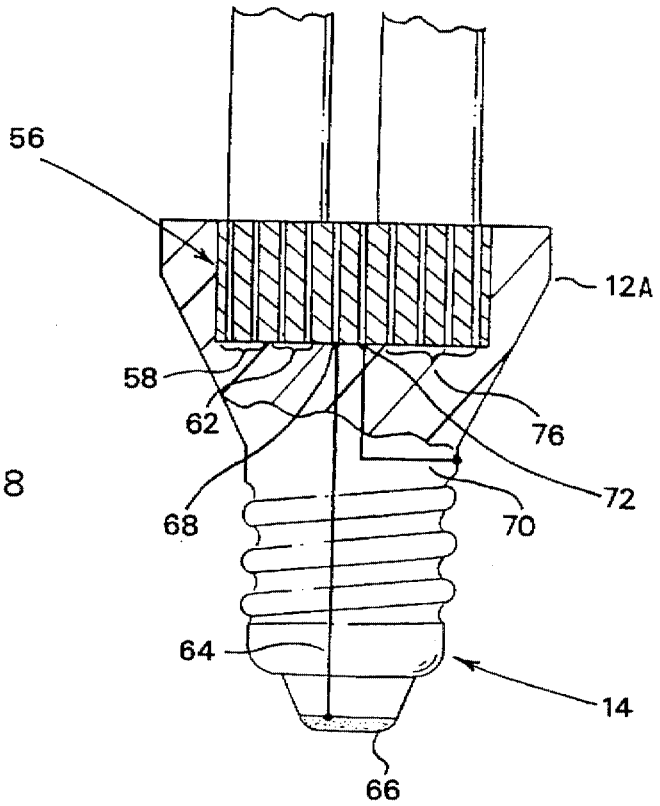
FIG. 8 shows a cross-section of a lower portion of the discharge lamp assembly on the line 8—8 of FIG. 6.

As is best seen in FIGS. 7 and 8, a ten pin socket 56 is embedded within the base 12A. A first pair of leads 57 extends from the lower ends of the first two sockets 58. The leads 57 extend into a cathode terminal 60 of the fluorescent U-tube 16A. A similar pair of leads (not shown) extend from second and third sockets 62 into an anode terminal of the U-tube 16A. A positive lead 64 extends from a base contact 66 of the fitting to the lower end of a fifth socket 68, and an earth or negative lead 70 extends from a sixth socket 72 to an outer earth or negative shell 74 of the screw fitting 14. The sixth to tenth sockets 76 are provided with corresponding leads which extend into the respective cathode and anode terminals of the U-tube 18A. One pair of cathode leads is shown at 78. The housing 22A terminates in a corresponding ten pin plug 80 which is arranged to plug into the socket 56.

Figure 9:
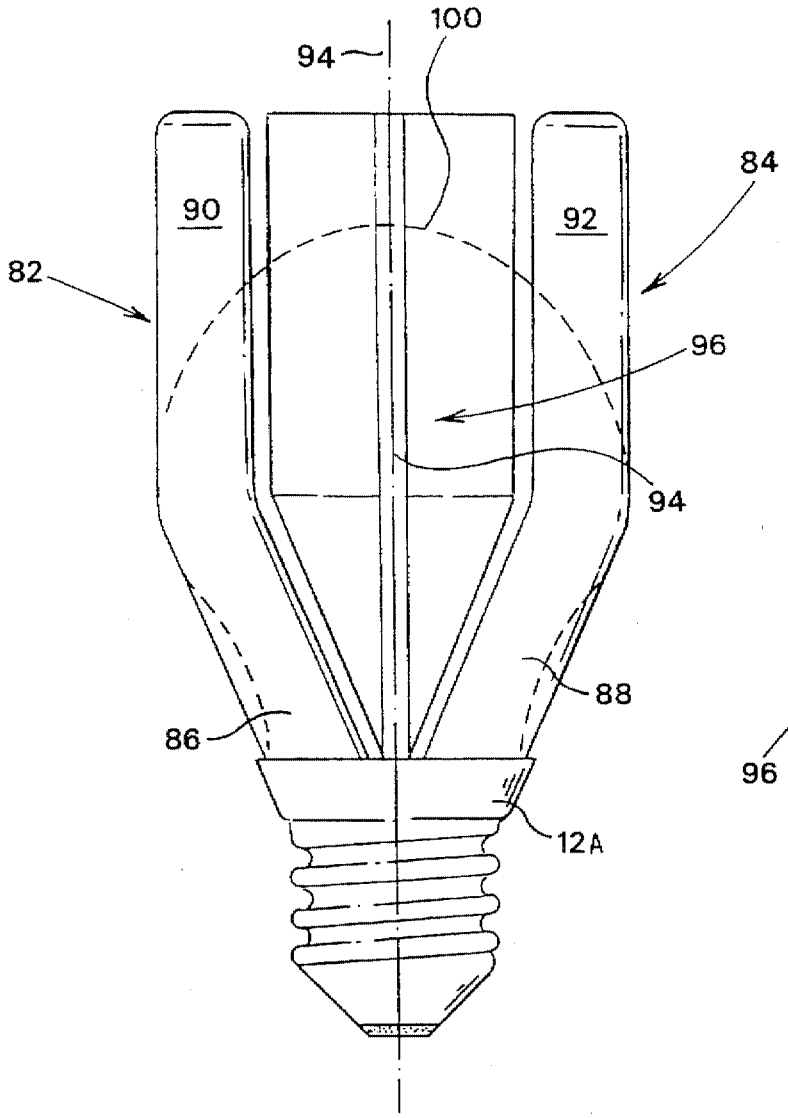
FIG. 9 shows a side view of a third embodiment of a low pressure discharge lamp assembly of the invention.
Figure 10:
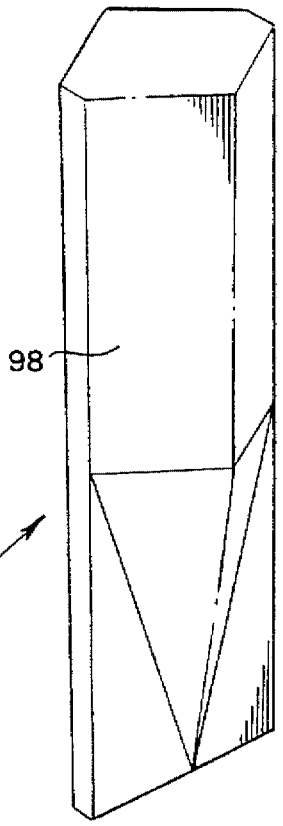
FIG. 10 shows a perspective view of a control circuit housing forming part of the lamp assembly of FIG. 9.

Turning now to FIG. 9, an alternative embodiment of a discharge lamp assembly is shown having a pair of U-tubes 82 and 84 with corresponding base portions 86 and 88 which extend upwardly from the base 12A in a splayed V-shaped configuration. The base portions 86 and 88 terminate in respective upright portions 90 and 92 which are parallel both to one another and to a central axis of symmetry 94. A suitably shaped control circuit housing 96 extends between the U-tubes 82 and 84. The housing has an upper portion 98 which is square-cylindrical in form, thereby allowing increased space for the various circuitry components such as the starter circuitry and the ballast. A conventional incandescent bulb is superimposed in broken outline at 100 onto the embodiment illustrated in FIG. 9. It is clear how the maximum widths of the incandescent bulb 100 and the fluorescent bulb assembly 84 correspond. It is also clear from this drawing how the base of the incandescent bulb 100 is approximately coterminous with the base 12A, thereby allowing the fluorescent light fitting 84 to be screwed into any socket which previously housed a conventional incandescent bulb of the type illustrated at 100.

Figure 11A:
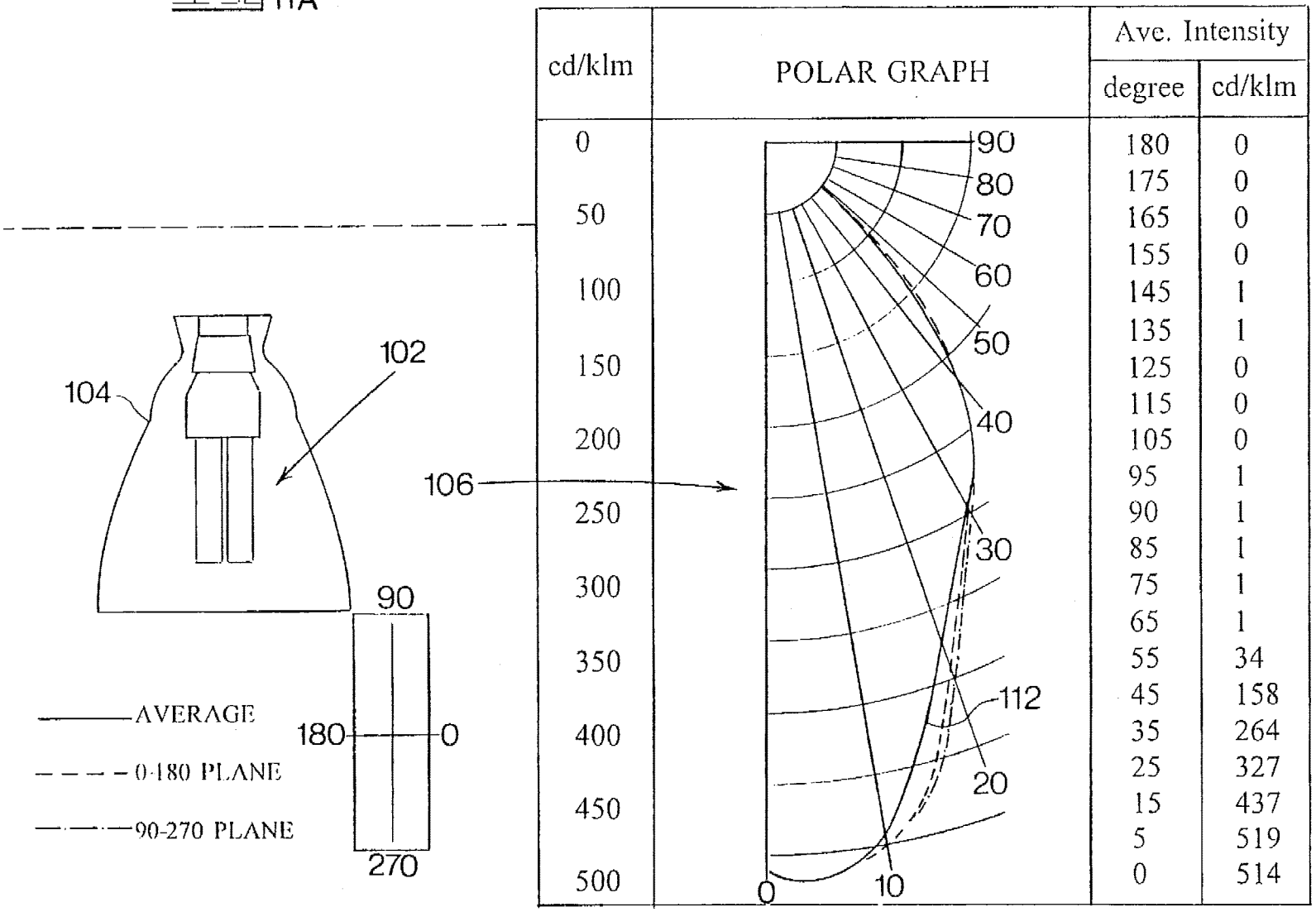
FIGS. 11A and 11B show polar light distribution graphs of a respective convention discharge lamp assembly and a discharge lamp assembly of the invention.

Referring now to FIG. 11A, a downlight sample test was performed in which a convention CAS-PROLUX® 11W-PLE-230V-S lamp assembly 102 was fitted within a cascade downlighter 104. At an average light intensity was measured over a luminous area of 300 $cm^2$ located beneath the downlighter 104. A accompanying polar graph 106 is shown in which average intensity in candelas per kilolumen was measured against degrees. Measurements were taken in the horizontal (0°–180°) as well as the vertical (90°–270°) planes. The same test was then performed with a fluorescent lamp assembly 48 of the type illustrated in FIG. 5, so as to yield a polar graph 108. It is clear from the graph 108 how the solid line 110 plotting the average light intensity has a more even distribution and a greater maximum value that the solid line 112 of the polar graph 106. This is as a result of the central reflective housing and the V-shaped configuration of the fluorescent bulbs.

In FIGS. 12 and 13, a fourth embodiment of a low pressure discharge lamp assembly 114 is shown comprising a single discharge tube having anode and cathode ends 116 and 118. The discharge tube comprises first, second and third pairs 120, 122 and 124 of tubular portions which are angled, in plan view, at 120° from one another. The first pair 120 comprises first and second tubular portions 120A and 120B which are joined to one another by means of a hollow bridging portion 126. The bridging portion is located towards the upper ends of the tubular portions 120A and 120B, and joining is achieved by means of a so-called "hot kiss" process. A similar bridging portion 128 connects the lower ends of adjacent tubular portions 120B and 122A, and subsequent bridging portions 130, 132 and 134 join the respective tubular portions 122A and 122B, 122B and 124A and 124A and 124B.

The first, second and third pairs of tubular portions 120, 122 and 124 are splayed away from one another in a V-shaped configuration at a splayed angle 136 of approximately 30° when viewed in a direction normal to the plane defined by adjacent tubular portions 120A and 124B.

As is clear from FIG. 13, the fixed ends 128 of the tubular portions are mounted to a base 130 from which a screw connector fitting 132 extends. The fixed end 128 of each tubular portion extends vertically upwards for a short distance parallel to the main axis of symmetry of the discharge lamp assembly, as is shown at 134, before splaying outwards at an angle of approximately 15° from the vertical.

Turning now to FIG. 14, a control circuit housing 136 is in the form of truncated triangular pyramid or wedge, having a small triangular base end 138 splaying outwardly to a large triangular top end 140, and having three side faces 142, 144 and 146. A printed circuit board forming the base of the control circuit is indicated in broken outline at 148, from which it can be seen that the particular wedge-shaped configuration of the housing provides plenty of space for the control circuitry. At the same time, the reflective side faces 142, 144 and 146 assist in the even distribution of light in the direction of arrows 148, in a situation in which the particular configuration of the discharge lamp assembly would normally result in an uneven trilobal light distribution in the absence of the reflective faces.

Figure 11B:
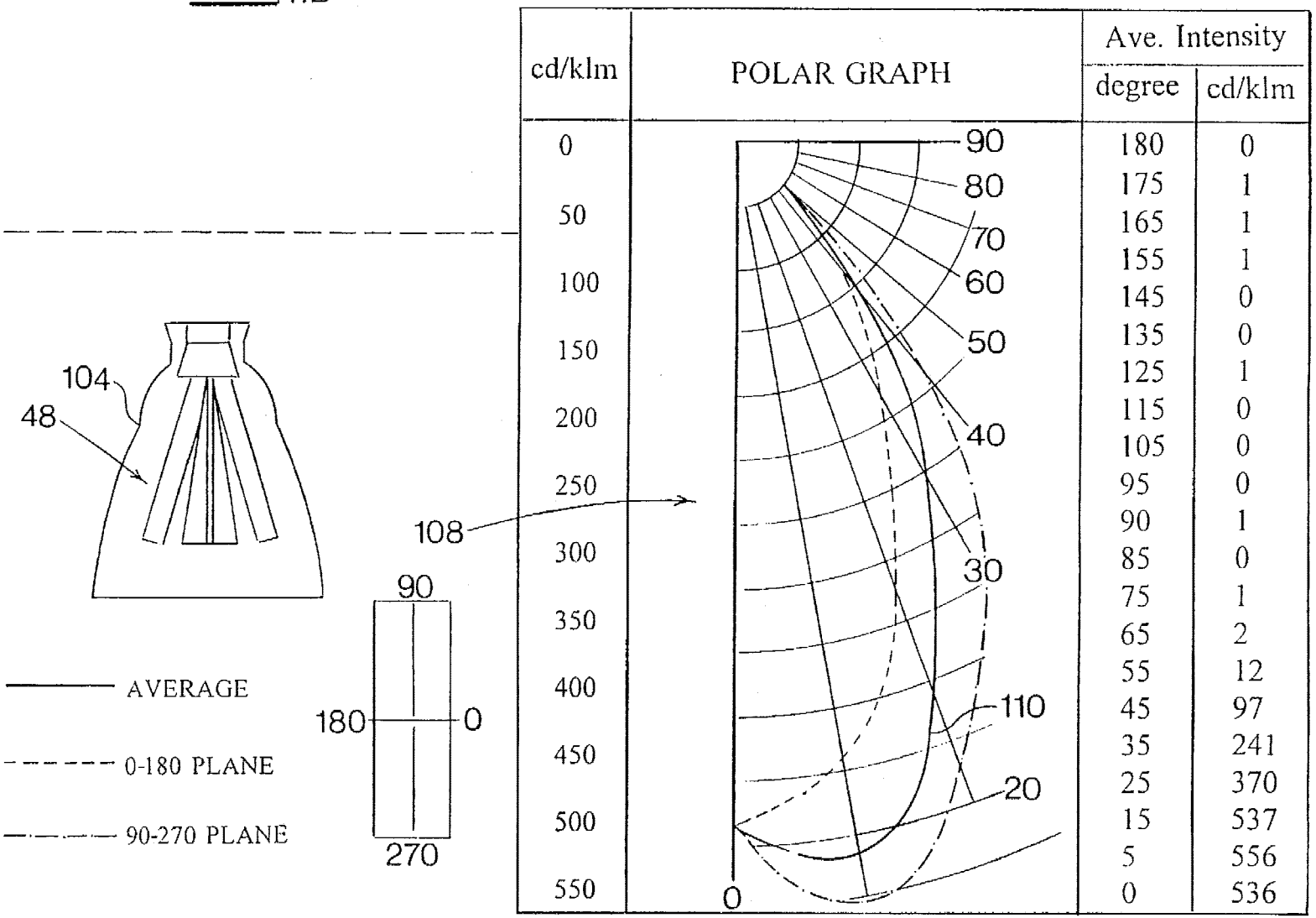

Turning now to FIGS. 15 and 16, a still further embodiment of a discharge lamp assembly 150 is shown. This embodiment has the same basic configuration as the embodiment illustrated in FIGS. 11 and 13, with three pairs of discharge tubes 152, 154 and 156 being splayed away from one another at an angle of 120°. A single discharge tube is provided, with the individual tubular portions being interconnected in the same manner as the embodiment of FIGS. 12 to 14. As is clear from FIG. 16, the discharge tube portion has a cranked configuration, with an initial vertical leg 158 merging into an outwardly angled leg 160 which is bent back into a vertically extending leg 162 towards the free end of the lamp assembly.

A control circuit housing 164 is designed to form a complemental fit within the space defined between adjacent pairs 152, 154 and 156 of the discharge tubes. The control circuit housing has a lower portion in the form of a truncated pyramid 166 followed by an upper portion 168 in the form of a triangular cylinder. Like the control circuit housing 136, the control circuit housing 164 has reflective side faces which enhance light distribution in the direction of arrows 170.

In FIGS. 18 and 19, a still further embodiment of a discharge lamp assembly 172 is shown. The discharge lamp assembly 172 also includes a single discharge tube which is bent into three U-shaped tubular portions 174, 176 and 178. As is clear from FIG. 19, each U-shaped portion comprises a pair of legs 174A and 174B. The legs 174A and 174B have outwardly splayed portions 179 extending from the base, with the fixed ends of the legs having a relatively short vertical portion 179A, similar to that illustrated in FIG. 16. The short vertical portion facilitates assembly of the discharge tube within the base, and provides for easier manufacture of the tube by allowing for easier pinching, evacuation and gassing of the tube. As is clear from FIG. 18, adjacent legs 174 and 174B and 176B and 178A are joined by bridging portions 180 using the aforementioned "hot kiss" process.

One possible form of control circuit housing is indicated in broken outline at 182, and has a hexagonal profile which tapers inwardly towards the base 130 so that the six intervening faces are essentially triangular in form.

Figure 20:
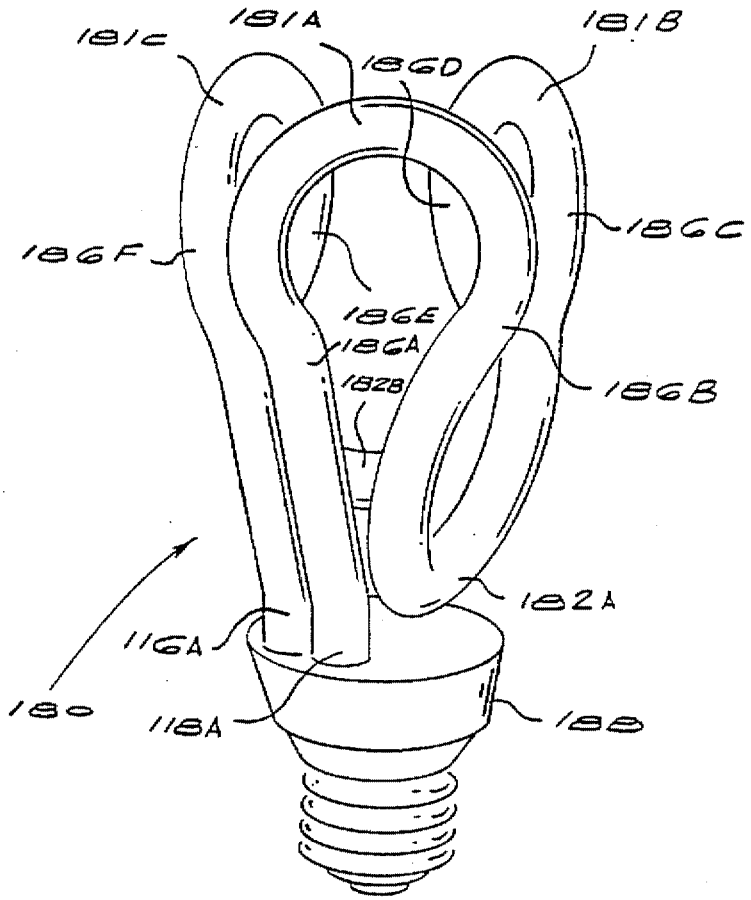
FIG. 20 shows a side view of a seventh embodiment of a low pressure discharge lamp assembly of the invention.
Figure 21:
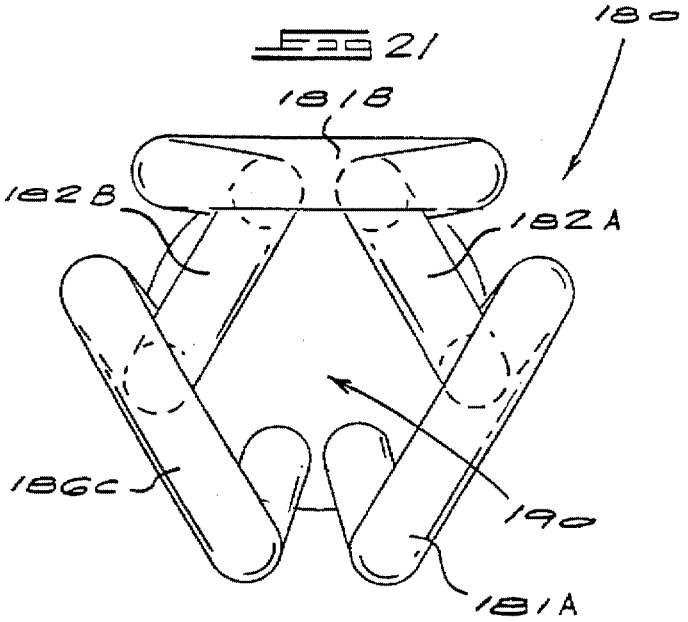
FIG. 21 shows a top plan view of the low pressure discharge lamp assembly of FIG. 20.

Referring now to FIGS. 20 and 21, a yet further embodiment of a discharge lamp assembly 180 of the invention is shown. The discharge lamp assembly 180 has a single discharge tube which is bent into a "serpentine" or "hairpin" format. The tube is formed with three larger upper bends 181A, 181B and 181C alternating with two smaller lower bends 182A and 182B, with the result that the tube doubles back on itself six times so as to define six limbs 186A, 186B, 186C, 186D, 186E and 186F. Each of the upper bends 181A, 181B and 181C are splayed outwardly relative to the lower bends 182A and 182B, as well as to the anode and cathode ends 116A and 118A of the tube.

It is clear from FIG. 21 how the looped tube portions defined by the limbs 186A and 186B, 186C and 186D and 186E and 186F splay outwardly from the base 188 of the lamp assembly in a configuration which is substantially V-shaped.

Although the control circuit housing is not separately illustrated, it is clear that the central gap 190 created by the tubes is able to accommodate a wedge-shaped control circuit housing in a snug and space-saving fit.

The fluorescent lamp assembly of the invention enjoys a number of advantages over conventional lamp assemblies. Its compact dimensions allow it to be fitted to conventional incandescent light sockets without having to change any light housings. For the same or an even greater light output, it has a power consumption considerably less than that of a conventional incandescent bulb. The bulbs can be replaced without disposing of the starter circuit, and vice versa.

Further, the wedge-shaped configuration is generally more volume-efficient than a cylindrical configuration. By way of explanation, a cylinder having a height h and a radius r has exacting the same diametrically cut cross-sectional area as a cone (an approximation of a multi-faceted wedge-shape) having a height h and a maximum radius 2r. The volume of the cone is over one third greater than the volume of the cylinder.

The fact that the control circuit housing contains electronic components for controlling the operation of the discharge tubes provides further cost-related advantages. By removing all the electronic components from the regularly replaced part of the discharge lamp assembly, namely the base and the discharge tubes, and inserting all of such components in the non-replaceable part, namely the plug-in-housing, there is a tendency to reduce the overall cost associated with replacing this part. This leads to advantages which are both financially and environmentally beneficial.

I claim:

1. A compact low pressure discharge lamp assembly for use in a lighting fixture comprising:

a base terminating in a fitting defining a central axis of symmetry normal to the base;

a discharge tube including six elongated tubular portions, said six elongated tubular portions having proximal ends terminating towards the base and opposed distal ends, said six elongated tubular portions beings arranged such that;

the first of said tubular portions has a cathode end joined to the base and is disposed adjacent and substantially parallel to a second of said tubular portions so as to define a first pair of tubular portions joined towards their distal ends and being angled outwardly relative to the central axis;

a third of said tubular portions is disposed adjacent and substantially parallel to a fourth of said tubular portions to define a second pair of tubular portions joined towards their distal ends and being angled outwardly relative to the central axis;

a fifth of said tubular portions is disposed adjacent and substantially parallel to a sixth of said tubular portions to define a third pair of tubular portions joined towards their distal ends and being angled outwardly relative to the central axis, with the sixth of said tubular portions having an anode end joined to the base adjacent the cathode end of the first of said tubular portions;

said first, second and third pairs of tubular portions being mutually splayed away from one another such that a V-shaped configuration exists;

between said first pair of tubular portions and said second pair of tubular portions, with the second of said tubular portions being joined to the third of said tubular portions towards the proximal ends thereof;

between said second pair of tubular portions and said third pair of tubular portions, with the fourth of said tubular portions being joined to the fifth of said tubular portions towards the proximal ends thereof; and between said third pair of tubular portions and said first pair of said tubular portions; and a control circuit housing mountable to the base opposite the fitting, the control circuit housing having a wedge-shaped profile for allowing it to next symmetrically between the first, second and third pairs of tubular portions, said discharge lamp assembly having a maximum width dimension determined by the distance between outermost surfaces of the distal ends of the discharge tubes.

2. The compact low pressure discharge lamp assembly according to claim 1, wherein said base has lateral dimensions substantially smaller than the maximum width dimension of the discharge lamp assembly so that no contribution to the maximum width dimension of the discharge lamp assembly is made by the base, and wherein said V-shaped configuration is taller than the control circuit housing so that no contribution to a height dimension of the assembly is made by the control circuit housing.

3. The compact low pressure discharge lamp assembly according to claim 1, wherein the control circuit housing has substantially triangular profile when viewed in plan, so as to define at least three reflective faces which are arranged to reflect light emitted from the six elongated tubular portions, each of said reflective faces being angled relative to the tubular portions so as to provide a substantially even distribution of reflected light from the discharge tube.

4. The compact low pressure discharge lamp assembly according to claim 1, wherein the control circuit housing houses electronic components for controlling the operation of the discharge tubes, including a ballast circuitry and a starter circuitry, said electronic components being located inside said V-shaped configuration and being shorter than said V-shaped configuration so that the electronic components are not contributing to the height and maximum width dimensions of the assembly.

5. The compact low pressure discharge lamp assembly according to claim 1, wherein the second and third, and the fourth and fifth tubular portions are joined at their proximal ends by a "hot kiss" connection.

6. The compact low pressure discharge lamp assembly according to claim 1, wherein the first and second, the third and fourth, and the fifth and sixth tubular portions are joined at their distal ends by a "hot kiss" connection.

7. The compact low pressure discharge lamp assembly according to claim 6, wherein joining of the first and second, third and fourth, and fifth and sixth tubular portions is of constant diameter with respect to the remainder of the tubular portions.

* * * * *